US010295275B2

(12) United States Patent
Hentschel

(10) Patent No.: US 10,295,275 B2
(45) Date of Patent: May 21, 2019

(54) FLAT TUBE FOR A HEAT EXCHANGER

(71) Applicant: Mahle International GmbH, Stuttgart (DE)

(72) Inventor: Gunther Hentschel, Uhingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/498,446

(22) Filed: Apr. 26, 2017

(65) Prior Publication Data

US 2017/0314875 A1 Nov. 2, 2017

(30) Foreign Application Priority Data

Apr. 27, 2016 (DE) ..... 10 2016 207 192

(51) Int. Cl.

| | |
|---|---|
| ***F28F 13/12*** | (2006.01) |
| ***F28F 1/08*** | (2006.01) |
| ***F28D 1/053*** | (2006.01) |
| ***F28F 1/02*** | (2006.01) |
| ***F28F 1/06*** | (2006.01) |

(52) U.S. Cl.

CPC ..... *F28F 1/08* (2013.01); *F28D 1/05375* (2013.01); *F28F 1/022* (2013.01); *F28F 1/06* (2013.01); *F28F 2250/102* (2013.01); *F28F 2250/106* (2013.01)

(58) Field of Classification Search

CPC ..... F28F 1/08; F28F 1/022; F28F 1/06; F28F 2250/102; F28F 2250/106; F28D 1/05375; F28D 1/05383; F21D 53/08

USPC ..... 165/109.1

See application file for complete search history.

(56) References Cited

U.S. PATENT DOCUMENTS

| | | | | |
|---|---|---|---|---|
| 5,271,151 | A | 12/1993 | Wallis | |
| 5,689,881 | A | 11/1997 | Kato | |
| 5,771,964 | A | 6/1998 | Bae | |
| 5,941,303 | A * | 8/1999 | Gowan | F28D 1/05383 165/140 |
| 6,016,864 | A | 1/2000 | Bae et al. | |
| 6,125,926 | A | 10/2000 | Okamoto et al. | |

(Continued)

FOREIGN PATENT DOCUMENTS

| | | | |
|---|---|---|---|
| DE | 19752139 | A1 | 5/1999 |
| DE | 69612767 | T2 | 10/2001 |

(Continued)

OTHER PUBLICATIONS

Extended European Search Report for EP 17166363.6 dated Sep. 20, 2017.

(Continued)

*Primary Examiner* — Davis D Hwu

(74) *Attorney, Agent, or Firm* — Fishman Stewart PLLC

(57) ABSTRACT

A flat tube for a heat exchanger may include a longitudinal-end inlet for letting a fluid into the flat tube, and a longitudinal-end outlet spaced apart from the inlet in a longitudinal direction for letting the fluid out from the flat tube. The flat tube may also include flow elements around at least a portion of which the fluid may be flowable around the flow elements in such a manner that the fluid may have a flow direction component perpendicular to the longitudinal direction. The outlet and the inlet each may be delimited on a partial cross-sectional area of the flat tube and arranged diagonally opposite one another.

20 Claims, 2 Drawing Sheets

(56) References Cited

U.S. PATENT DOCUMENTS

| | | | | |
|---|---|---|---|---|
| 6,202,741 | B1 | 3/2001 | Demuth et al. | |
| 6,286,201 | B1 | 9/2001 | Prater et al. | |
| 7,841,393 | B2 | 11/2010 | Sekito et al. | |
| 2008/0105414 | A1 | 5/2008 | Hassenteufel | |
| 2011/0030932 | A1* | 2/2011 | Tucker ..... | B21D 53/08<br>165/151 |

FOREIGN PATENT DOCUMENTS

| | | | |
|---|---|---|---|
| DE | 102004055341 | A1 | 5/2006 |
| DE | 102004056592 | A1 | 5/2006 |
| DE | 102007035581 | A1 | 3/2008 |
| DE | 19883002 | B4 | 4/2008 |
| DE | 102006057662 | A1 | 6/2008 |
| DE | 112013003004 | T5 | 2/2015 |
| DE | 102015204983 | A1 | 9/2016 |
| GB | 182144 | A | 6/1922 |
| WO | 2016146294 | A1 | 9/2016 |

OTHER PUBLICATIONS

English abstract for DE-102004055341.
English abstract for DE-102006057662.
English abstract for DE-102015204983.
English abatract for DE-112013003004.

* cited by examiner

FLAT TUBE FOR A HEAT EXCHANGER

CROSS-REFERENCE TO RELATED APPLICATIONS

This application claims priority to German Application No. DE 10 2016 207 192.0, filed on Apr. 27, 2016, the contents of which are incorporated by reference in its entirety.

TECHNICAL FIELD

The present invention relates to a flat tube for a heat exchanger having a longitudinal-end inlet and a longitudinal-end outlet. The invention further relates to a heat exchanger having such a flat tube.

BACKGROUND

Heat exchangers are used for exchanging heat between two fluids. For this purpose heat exchangers usually have tubes, in particular flat tubes, through which one of these fluids flows and around which the other fluid flows. In so-called cross-flow heat exchangers, the first fluid and the second fluid flow transversely to one another and thus allow heat exchange between the fluids via the flat tube.

In order to increase the efficiency of these heat exchangers, it is desirable to improve the degree of heat exchange between the flat tube through which the first fluid flows and the second fluid. For this purpose, for example, heat transfer structures, in particular ribs, arranged between the flat tubes, for example are used.

In order to improve the degree of heat exchange, in particular for a more homogeneous heat exchange between the fluids, DE 10 2007 035 581 A1 proposes to partially block the inlet or the outlet of such flat tubes in a heat exchanger in the area of an inflow or outflow of appurtenant collectors through which the first fluid flows. In DE 10 2004 056 592 A1 it is proposed to provide a bypass device in these collectors which diverts the fluid flowing through the flat tubes and the collectors between neighbouring flat tubes. It is known from DE 197 52 139 A1 to provide flat tubes with two inlets and two outlets each wherein the inlets and the outlets are separated from one another by a beading running in the longitudinal direction.

However these measures leave something to be desired with regard to the efficiency of the appurtenant heat exchangers, in particular with regard to the degree of heat exchange between the flat tube and the second fluid flowing around the flat tube.

SUMMARY

The present invention is therefore concerned with the problem of providing improved and at least alternative embodiments for a flat tube for a heat exchanger and for such a heat exchanger, which are characterized in particular by an improved degree of heat exchange.

This problem is solved according to the invention by the subject matters of the independent claims. Advantageous embodiments are the subject matter of the dependent claims.

The present invention is based on the general idea of configuring a flat tube for a heat exchanger in such a manner that the flat tube can have an appurtenant fluid flowing through it both in the longitudinal direction and also at least partially perpendicular or transversely to the longitudinal direction and therefore has a flow direction component perpendicular to the longitudinal direction. By this means, in a heat exchanger configured according to the cross-flow principle in which the heat-exchanging fluids intersect in a fluidically separate manner, it is possible to increase the degree of heat exchange. In particular, the heat exchange takes place between the fluid flowing through the flat tube, hereinafter called first fluid and the fluid flowing around the flat tube, hereinafter called second fluid, both in the longitudinal direction of the flat tube and also perpendicular or transversely thereto and therefore in the transverse direction of the flat tube. The flat tube or the appurtenant heat exchanger is in this case advantageously configured in such a manner that the first fluid flowing in the transverse direction flows contrary to the flow direction of the second fluid and consequently a counter-flow to the second fluid is achieved which results in particularly advantageous degrees of heat exchange between the fluids. By means of the flat tube according to the invention, therefore both a cross-flow and a counter-flow of the first fluid relative to the second fluid is achieved. It corresponds to the inventive idea that the flat tube has an inlet for letting in the first fluid into the flat tube and an outlet for letting out the first fluid from the flat tube which are arranged at opposite ends of the flat tube in the longitudinal direction or at the longitudinal-end side. According to the invention, it is provided that the outlet and the inlet are each only delimited on a partial cross-sectional area of the flat tube and are arranged diagonally opposite one another. As a result of the diagonal arrangement of inlet and outlet, this not only results in a flow of the first fluid running along the longitudinal direction, i.e. a cross-flow of the first fluid but also in a flow component running perpendicular or transversely to the longitudinal direction and therefore also in a flow of the first fluid running in the transverse direction, i.e. in a counter-flow of the first fluid relative to the second fluid. According to the invention, flow elements are additionally provided in the flat tube, wherein the flow elements can have the first fluid flowing around them in such a manner that the first fluid has a flow direction component perpendicular or transverse to the longitudinal direction. The flow of the first fluid is therefore intensified by the flow elements or the flow direction component perpendicular to the longitudinal direction is enlarged.

The intensification of the flow direction component perpendicular to the longitudinal direction can here be due to the formation and also due to the arrangement of the flow elements. The flow elements are preferably configured in such a manner that they build up a pressure gradient in the transverse direction in such a manner that the first fluid flows in the transverse direction and therefore has the flow direction component perpendicular to the longitudinal direction. In this case, the flow elements are preferably arranged in the flat tube or inside the flat tube.

The flat tube has larger dimensions in the transverse direction than a thickness running transversely to the transverse direction and transversely to the longitudinal direction. In particular the extension of the flat tube in the transverse direction can be at least twice as great as the thickness.

According to an advantageous embodiment, the flat tube has an inlet section running in a transverse direction, an outlet section running in transverse direction in particular spaced apart from the inlet section and a heat exchange section arranged in the transverse direction between the inlet section and the outlet section in which the flow elements are arranged. In this case, the inlet section contains the inlet whilst the outlet section contains the outlet. The flow elements are arranged in the heat exchange section. In particular it is provided that inlet section and outlet section are free from flow elements. By this means the advantages of the diagonal arrangement of inlet and outlet and the flow elements are advantageously combined.

These advantages can be increased whereby a cross-section of the inlet section decreases in the longitudinal direction towards the outlet and/or a cross-section of the outlet section decreases in the longitudinal direction towards the inlet. In particular, the inlet section and/or the outlet section can run in a wedge shape in the longitudinal direction.

It is conceivable that the heat exchange section runs uniformly in the longitudinal direction. Preferably the heat exchange section runs obliquely in longitudinal direction. This intensifies the flow direction component of the first fluid perpendicular to the longitudinal direction.

In preferred embodiments at least two lines of these flow elements spaced apart in the longitudinal direction are provided, wherein the respective line has at least two flow elements spaced apart in the transverse direction. This results in a deflection of the first fluid from a first transverse end at which the inlet is arranged in the direction of a second transverse end of the flat tube at which the outlet is arranged. Accordingly, the fraction of the flow of the first fluid in the transverse direction or the flow direction component perpendicular to the longitudinal direction is increased and the degree of heat exchange is thus improved.

Preferably the respective flow element extends in its longitudinal direction in the transverse direction of the flat tube. That is, the flow elements extend in their longitudinal extension in the transverse direction and are spaced apart from one another in the respective line.

Particularly preferred here are embodiments in which the flow elements of lines spaced apart from one another in the longitudinal direction are arranged with respect to one another in running bond manner. That is, that the flow elements of neighbouring lines in the longitudinal direction, in particular of nearest-neighbour lines in the longitudinal direction are arranged offset in the transverse direction.

It is also conceivable to provide the flat tube with at least two columns of such flow elements, wherein the respective column has at least two flow elements spaced apart in the longitudinal direction and wherein the columns are spaced apart from one another in the transverse direction.

It is preferred here if the flow elements extend in their longitudinal extension along the longitudinal direction. It is further preferred if the flow elements of neighbouring columns in the transverse direction, in particular of nearest-neighbour columns in the transverse direction are arranged offset in the longitudinal direction, in particular form a running bond.

In advantageous embodiments the flow elements are arranged in such a manner that a diagonal meander-shaped flow of the fluid is obtained in the flat tube. This is in particular achieved by such columns of flow elements.

The respective flow element can in principle be arbitrarily configured provided that, at least with further flow elements, it results in a flow direction component of the first fluid perpendicular or transverse to the longitudinal direction. It is conceivable, for example, to configure the respective flow element as a turbulator, a dimple, an inner rib, an embossing and the like. It is also conceivable to configure at least one such flow element as a porous structure. Variants are also conceivable in which at least one such flow elements comprises a porous material, in particular a metal foam, or is configured as such a material, in particular metal foam.

In principle, the flow elements of the flat tube can have different shapes and/or sizes. It is also conceivable that the flow elements of the flat tube have the same shape and/or size.

Embodiments are also feasible in which the flow elements are combined in a turbulence insert formed separately to the flat tube. That is, that the flow elements can be formed separately from the flat tube and inserted into the flat tube, in particular connected to the flat tube. As a result, it is in particular possible to form flat tubes from the prior art in a simplified manner to flat tubes according to the invention.

It is also conceivable that the flow elements are formed as integral components of the flat tubes which significantly simplifies manufacture.

It is preferred if the flow elements are configured as inwardly directed deformations of the flat tube, in particular as embossings, for example as dimples. This reduces the number of components of the flat tube and accompanying this reduces the assembly expenditure. In addition, an increased number of flow elements and/or a greater variability of shapes and sizes of flow elements can be achieved. The flat tube can thus be provided with flow elements in a simple manner.

The inwardly directed deformations to form the flow elements extend at least over a part of the thickness of the flat tube, whereby the thickness of the flat tube runs transversely to the longitudinal direction and transversely to the transverse direction.

Also preferred are embodiments in which the flow elements configured as inwardly directed deformation touch an opposite wall of the flat tube. That is in particular, that the opposite walls of the flat tube along the thickness of the flat tube are in contact with one another via such flow elements. As a result, it is possible to particularly effectively achieve the flow direction component of the first fluid perpendicular to the longitudinal direction.

It is conceivable to distribute the flow elements uniformly over the entire flat tube, in particular uniformly in the heat exchange section. Embodiments are also feasible in which the flat tube has no such flow elements in the longitudinal direction in the area of the inlet and/or in the area of the outlet, that is it is free from such flow elements.

The flat tube according to the invention is preferably used in a heat exchanger which additionally has two opposite collectors for collecting and/or distributing the first fluid in the flat tube or from the flat tube. One of the collectors can be configured as an inlet collector for letting the first fluid into the flat tube and the other collector as an outlet collector for letting the first fluid out of the flat tube. It is also conceivable that the respective collector distributes the fluid between different flat tubes, i.e. functions both as inlet collector and also as outlet collector or as deflector. The first fluid therefore flows in the collectors and the flat tube. Here the second fluid flows around the flat tube. It is particularly preferred here if the second fluid flows through the heat exchanger contrary to the transverse direction or contrary to the flow direction component of the first fluid perpendicular to the longitudinal direction of the flat tube in such a manner that the second fluid flows around the flat tube contrary to the transverse direction. In addition to the flow of the first fluid in the longitudinal direction, this results in a flow around the flat tube transversely to the longitudinal direction and contrary to the transverse direction and therefore in a cross counter-flow. This cross counter-flow allows particularly high degrees of efficiency of the heat exchange between the first fluid and the second fluid and therefore a particularly high efficiency of the heat exchanger.

The respective collector can have a base with passages in which the flat tubes are received at the longitudinal ends. Thus, the inlet and the outlet of the flat tube are each in fluidic communication with the appurtenant collector.

It is also conceivable to provide the heat exchanger with two such inlet collectors and a common such outlet collector wherein at least one such flat tube is arranged between the outlet collector and the respective inlet collector. That is, that the heat exchanger has a first inlet collector and a second inlet collector as well as such an outlet collector, wherein at least a first flat tube runs between the first inlet collector and the outlet collector and at least a second flat tube runs between the second inlet collector and the outlet collector.

Embodiments are also feasible here in which the first flat tube and the second flat tube run at an inclination to one another, in particular transversely to one another. As a result, in particular a particularly space-saving configuration of the heat exchanger is possible.

Naturally two or more such flat tubes can run between the respective inlet collector and the respective outlet collector, wherein at least one such flat tube is configured according to the invention.

The heat exchanger can be used in any application for heat exchange between two fluids. The heat exchanger can in particular be used in a motor vehicle. It is possibly feasible to use the heat exchanger for cooling a coolant as first fluid which flows through the flat tubes. The second fluid for cooling the coolant can in this case be air, in particular airstream of the motor vehicle which flows around the flat tubes. The coolant can be used for cooling a drive device of the motor vehicle, in particular an internal combustion engine of the motor vehicle.

Further important features and advantages of the invention are obtained from the subclaims, from the drawings and from the relevant description of the figures with reference to the drawings.

It is understood that the features mentioned previously and to be explained further hereinafter can be used not only in the respectively given combination but also in other combinations or alone without departing from the scope of the present invention.

Preferred exemplary embodiments of the invention are presented in the drawings and are explained in detail in the following description, where the same reference numbers relate to the same or similar or functionally the same components.

BRIEF DESCRIPTION OF THE DRAWINGS

In the figures, in each case schematically

DETAILED DESCRIPTION

Figure 1:
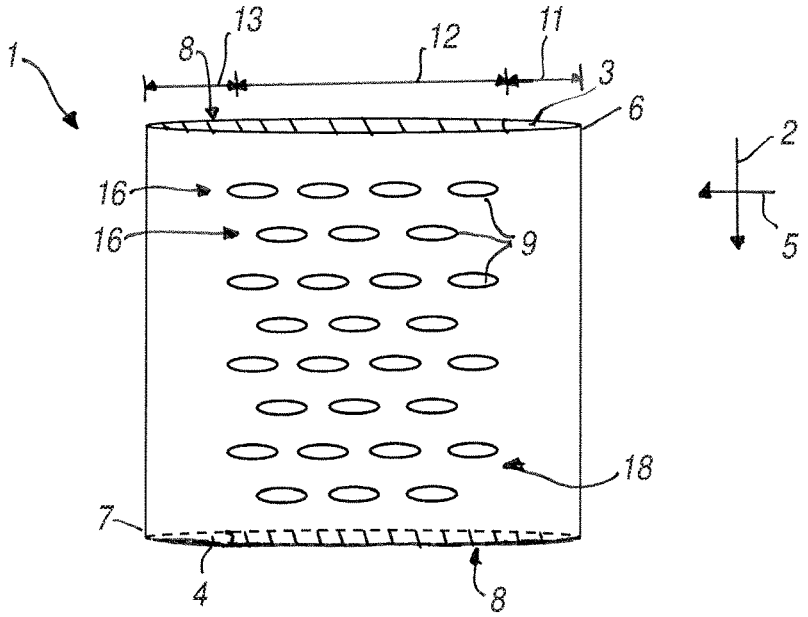
FIG. 1 shows a spatial view of a flat tube.

According to FIG. 1, the flat tube 1 has two longitudinal end sides 8 along a longitudinal direction 2, wherein an inlet 3 is arranged on one of the longitudinal end sides 8 and an outlet 4 is arranged on the opposite longitudinal end side 8. Inlet 3 and outlet 4 are used to let a first fluid into the flat tube 1 or to let the first fluid out of the flat tube 1. Inlet 3 and outlet 4 are in this case delimited to a partial cross-sectional area of the flat tube 1 and are arranged offset with respect to one another in a transverse direction 5 running transversely to the longitudinal direction 2. The inlet 3 is arranged on a first transverse end 6 running contrary to the transverse direction 5 whilst the outlet 4 is arranged at a second transverse end 7 of the flat tube 1 in the transverse direction 5. Inlet 3 and outlet 4 are thus arranged diagonally opposite one another. In addition, the longitudinal end sides 8 of the flat tube 1 are closed and therefore the first fluid cannot flow through it. A plurality of flow elements 9 are provided in the flat tube 1 around which the first fluid can flow in such a manner that the flowing first fluid has a flow direction component perpendicular to the longitudinal direction 2 or in transverse direction 5.

Figure 2:
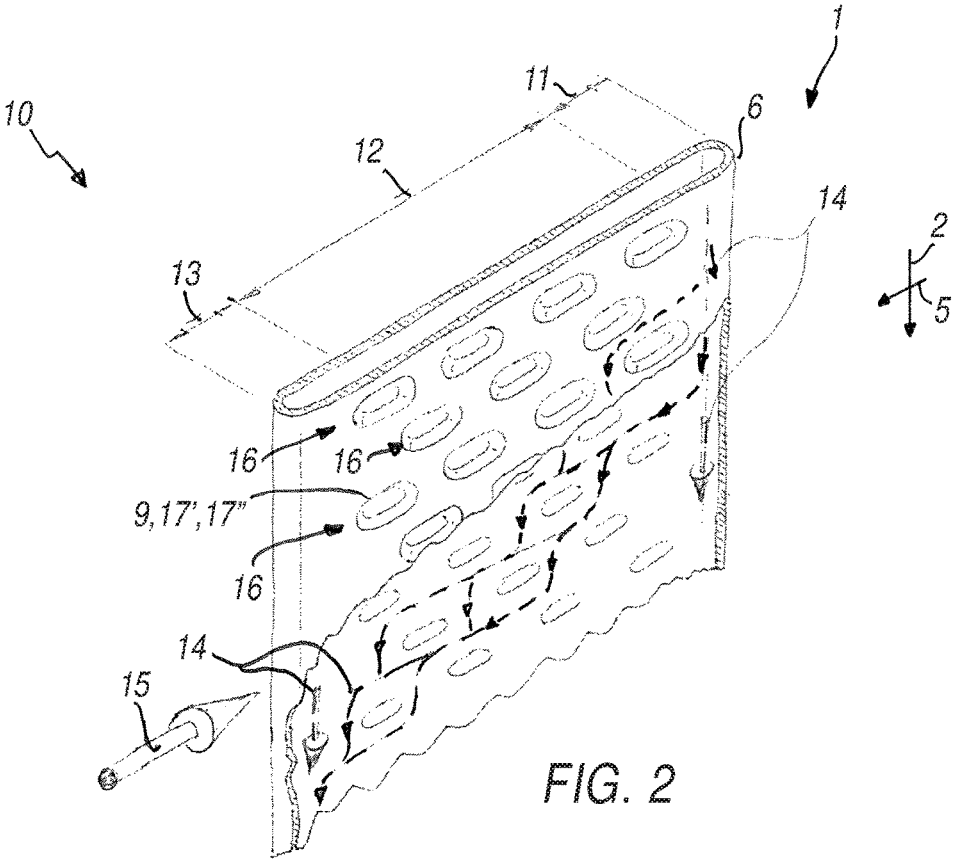
FIG. 2 shows a section through a heat exchanger in the area of the flat tube in another exemplary embodiment of the flat tube, wherein the flat tube is shown partially cutaway.

The flat tube 1 is used, as shown in FIG. 2 in a heat exchanger 10, wherein the flat tube 1 is shown partially cutaway in FIG. 2. The flat tube 1 can be divided into three sub-sections 11, 12, 13 in transverse direction 5. The inlet 3 is arranged in an inlet section 11 which is arranged in the area of the first transverse end 6. The flow elements 9 are arranged in a heat exchange section 12 whereas the outlet 4 is arranged in an outlet section 13 which is arranged in the area of the second transverse end 7. The heat exchange section 12 is arranged between inlet section 11 and outlet section 13, wherein inlet section 11 and outlet section 13 are free from flow elements 9. The inlet section 11 and the outlet section 13 as well as the inlet 3 and the outlet 4 are substantially the same size whereas the heat exchange section 12 is many times larger in transverse direction 5 than the inlet section 11 and the outlet section 13, in the example shown for example five times greater than the inlet section 11 or the outlet section 13. If the first fluid, as indicated by first dashed arrows 14, flows through the inlet 3 into the flat tube 1, it initially enters into the flat tube 1 in the inlet section. As a result of the offset arrangement of the outlet 4 and the flow elements 9, the first fluid in the flat tube 1 has the flow direction component perpendicular to the longitudinal direction 2 and is therefore deflected in transverse direction 5 in the direction of the outlet section 13 and thereby passes the heat exchange section 12. The first fluid then passes through the outlet 4 in the outlet section 13 from the flat tube 1. The first fluid therefore flows both in longitudinal direction 2 and also in transverse direction 5. In the heat exchanger 10 the first fluid exchanges heat with a second fluid wherein the second fluid, as indicated by a second arrow 15, flows contrary to the transverse direction 5 through the heat exchanger 10 and flows around the flat tube 1. Consequently, the first fluid flows through the flow in longitudinal direction 2 in cross-flow to the second fluid and through the flow in transverse direction 5 contrary to the flow direction of the second fluid or in the counter-flow direction. A cross-counter-flow of the first fluid to the second fluid is therefore achieved by means of the flat tube 1. The first fluid and the second fluid thereby flow through the heat exchanger in a fluidically separated manner.

In the exemplary embodiments of the flat tube 1 shown in FIGS. 1 and 2 the flow elements 9 are grouped in lines 16. The lines 16 are spaced apart in longitudinal direction 2 and each have at least two such flow elements 9, wherein the flow elements 9 of the respective line 16 are spaced apart in transverse direction 5. In addition, the longitudinal extension of the respective flow element 9 runs in transverse direction 5. It can be further deduced from FIGS. 1 and 2 that the flow elements 9 of neighbouring lines 16 are arranged in running bond manner with respect to one another. That is that the flow elements 9 of neighbouring lines 16 in longitudinal direction 2 are arranged offset with respect to one another in transverse direction 5, wherein in the example shown the respective flow element 9 in transverse direction 5 is arranged substantially centrally between the neighbouring flow elements 9 in transverse direction 5 of the neighbouring lines 16 in longitudinal direction 2.

In the exemplary embodiment shown in FIG. 2, the flow elements 9 are each configured as an inwardly directed deformation 17, in particular an embossing 17' of the flat tube 1 or a dimple 17". The flow elements 9 are therefore an integral component of the flat tube 1.

Alternatively the flow elements 9, as shown in FIG. 1, can be combined in a turbulence insert 18 configured separately to the flat tube 1. The turbulence insert 18 is arranged in the flat tube 1 and connected to the flat tube 1.

Figure 3:
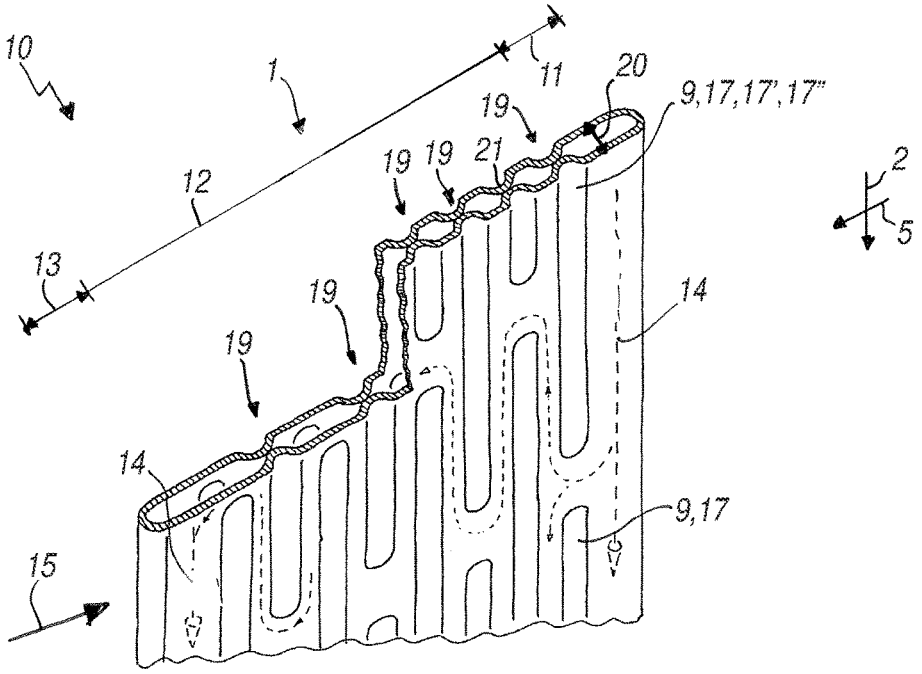
FIG. 3 shows the view from FIG. 2 in a further exemplary embodiment of the flat tube, FIGS. 4 to 6 each shows a longitudinal section through the heat exchanger in respectively different exemplary embodiments.

FIG. 3 shows another exemplary embodiment of the flat tube 1 in the heat exchanger 10. In this exemplary embodiment the flow elements 9 are combined in columns 19 which are spaced apart from one another in transverse direction 5. The respective column 19 has flow elements 9 which are spaced apart from one another in longitudinal direction 2. The flow elements 9 of the columns 19 extend with their longitudinal extension in longitudinal direction 2. The flow elements 9 of neighbouring columns 19 in transverse direction 5 are arranged with respect to one another in the running bond in such a manner that the flow elements 9 of neighbouring columns 19 in transverse direction 5 are arranged offset with respect to one another in longitudinal direction 2. This results in a diagonal meander-shaped flow of the first fluid in the flat tube 1, as indicated by the dashed first arrows 14.

It is further deduced from FIG. 3 that the flow elements 9 are configured as such inwardly directed deformations 17, in particular as embossings 17' or dimples 17" of the flat tube 1. It can be further identified in FIG. 3 that the respective deformation 17 extends over at least a part of a thickness 20 of the flat tube 1 running transversely to the longitudinal direction 2 and transversely to the transverse direction 5. In the exemplary embodiment shown in FIG. 3 the opposite walls 21 of the flat tube 1 along the thickness 20 are in contact and therefore touch. In this way, a particularly effective deflection of the first fluid in transverse direction 15 and therefore a large flow direction component of the first fluid perpendicular to the longitudinal direction 2 or in transverse direction 5 is possible.

The heat exchanger 10 can naturally also have a plurality of such flat tubes 1 which each having the second fluid flowing around them.

Figure 4:
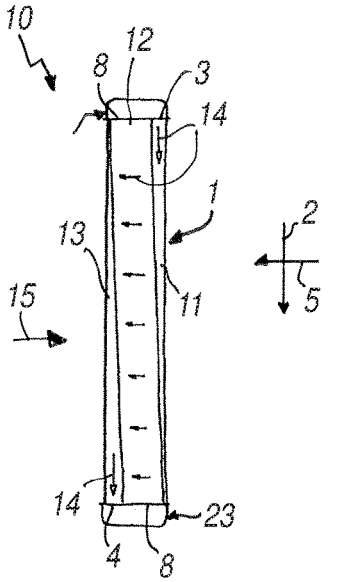

FIG. 4 shows a longitudinal section through the heat exchanger 10 of another exemplary embodiment. It can be seen here that the heat exchange section 12 runs obliquely in longitudinal direction 2 whilst the cross-section of the inlet section 11 decreases towards the outlet in longitudinal direction 5 and vanishes or falls to zero at the longitudinal end 8 of the outlet 4. The outlet section 13 decreases in longitudinal direction 2 towards the inlet and is reduced to zero at the longitudinal end 8 of the inlet 3. The heat exchanger 10 additionally has two opposite collectors 22 23, in longitudinal direction 2, namely an inlet collector 22 for letting the first fluid into the at least one flat tube 1 and an outlet collector 23 for letting the first fluid out of the at least one flat tube 1 which are arranged spaced apart from one another in longitudinal direction 2. The fluidic communication between the flat tube 1 and the respective collector 22, 23 can be achieved, for example, by means of non-visible passages formed in a base not shown of the respective collector 22, 23.

Figure 5:
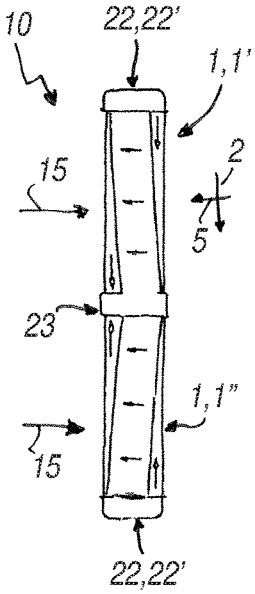

A further exemplary embodiment of the heat exchanger 10 is shown in FIG. 5. In this exemplary embodiment the heat exchanger 10 has two such inlet collectors 22, namely a first inlet collector 22' and a second inlet collector 22". A common such outlet collector 23 is arranged between the inlet collectors 22, wherein the respective inlet collector 22 is fluidically connected to the outlet collector 23 by means of at least one such flat tube 1 in such a manner that at least one such flat tube 1' runs between the first inlet collector 22' and the outlet collector 23 and at least one such second flat tube 1" runs between the second inlet collector 22' and the outlet collector 23. The first flat tube 1' and the second flat tube 1" have a common longitudinal direction 2 or are arranged parallel. The flat tubes 1' and 1" here each correspond to the flat tube 1 from FIG. 4.

Figure 6:
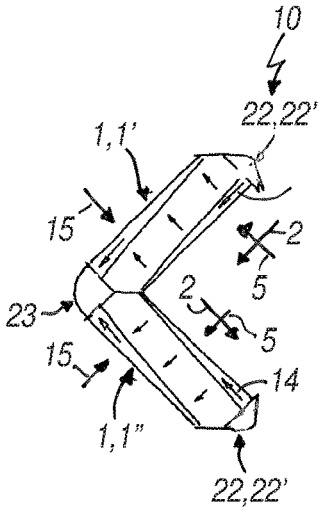

A further exemplary embodiment of the heat exchanger 10 is shown in FIG. 6. This exemplary embodiment differs from the exemplary embodiment shown in FIG. 5 in particular in that the first flat tube 1' and the second flat tube 1" are run at an inclination, in particular transversely to one another. This results in an angled, in particular L-shaped configuration of the heat exchanger 10. In this exemplary embodiment therefore the longitudinal directions 2 of the first flat tube 1' and the second flat tube 1" run at an inclination, in particular, transversely to one another. Here the outlet collector 23 has a different shape to the outlet collector 23 in FIGS. 4 and 5.

The invention claimed is:

1. A flat tube for a heat exchanger, comprising:

a longitudinal-end inlet for letting a fluid into the flat tube;

a longitudinal-end outlet spaced apart from the inlet in a longitudinal direction for letting the fluid out from the flat tube, wherein the longitudinal-end outlet is at an end of the flat tube that is opposite that of the longitudinal-end inlet; and flow elements around at least a portion of which the fluid is flowable around the flow elements in such a manner that the fluid has a flow direction component perpendicular to the longitudinal direction;

wherein the outlet and the inlet are each delimited on a partial cross-sectional area of the flat tube and are arranged diagonally opposite one another.

2. The flat tube according to claim 1, further comprising:

an inlet section running in a transverse direction transverse to the longitudinal direction, the inlet section containing the inlet;

an outlet section running in the transverse direction and containing the outlet; and a heat exchange section arranged in the transverse direction between the inlet section and the outlet section, the flow elements being arranged in the heat exchange section.

3. The flat tube according to claim 2, wherein at least one of:

a cross-section of the inlet section decreases in the longitudinal direction towards the outlet; and a cross-section of the outlet section decreases in the longitudinal direction towards the inlet.

4. The flat tube according to claim 3, wherein at least one of the inlet section and the outlet section runs in a wedge shape in the longitudinal direction.

5. The flat tube according to claim 2, wherein the heat exchange section runs obliquely in the longitudinal direction.

6. The flat tube according to claim 1, wherein the flow elements are arranged in at least two lines spaced apart in the longitudinal direction, wherein each line has at least two flow elements spaced apart in a transverse direction transverse to the longitudinal direction.

7. The flat tube according to claim 6, wherein the flow elements of one line are arranged offset in the transverse direction to the flow elements in an adjacent line.

8. The flat tube according to claim 1, wherein the flow elements are at least partially combined in a turbulence insert formed separately from a body of the flat tube.

9. The flat tube according to claim 1, wherein at least one flow element is formed as an inwardly directed deformation of a body of the flat tube.

10. The flat tube according to claim 9, wherein at least one flow element configured as an inwardly directed deformation touches an opposite wall of the body of the flat tube.

11. The flat tube according to claim 1, wherein at least one flow element includes a porous material.

12. The flat tube according to claim 1, wherein the flow elements are arranged such that the fluid is flowable in the flat tube in a diagonal meander-shaped.

13. A heat exchanger comprising:

two opposite collectors;

at least two flat tubes arranged between the two opposite collectors, each flat tube including:

a longitudinal-end inlet for letting a fluid into the flat tube, the longitudinal-end inlet at a first end of the flat tube;

a longitudinal-end outlet spaced apart from the inlet in a longitudinal direction for letting the fluid out from the flat tube, the longitudinal-end outlet at a second end of the flat tube that is opposite the first end of the flat tube; and flow elements around at least a portion of which the fluid is flowable around the flow elements in such a manner that the fluid has a flow direction component perpendicular to the longitudinal direction;

the outlet and the inlet each being delimited on a partial cross-sectional area of the flat tube and arranged diagonally opposite one another;

wherein a first fluid flows in the flat tubes and the collectors, and the second fluid flows around the flat tubes.

14. The heat exchanger according to claim 13, wherein a flow through the heat exchanger takes place in a cross-counter-flow.

15. The heat exchanger according to claim 13, further comprising a first inlet collector and a second inlet collector, and an outlet collector is arranged therebetween the inlet collectors, and at least one flat tube is arranged between each inlet collector and the outlet collector.

16. The heat exchanger according to claim 15, wherein at least one flat tube between the first inlet collector and the outlet collector and at least one flat tube between the second inlet collector and the outlet collector are arranged inclined to one another.

17. The flat tube according to claim 9, wherein the inwardly directed deformation is at least one of an embossing and a dimple.

18. The flat tube according to claim 11, wherein the porous material is a metal foam.

19. The heat exchanger according to claim 16, wherein the at least one flat tube between the first inlet collector and the outlet collector and the at least one flat tube between the second inlet collector and the outlet collector are arranged transversely to one another.

20. A flat tube for a heat exchanger, comprising:

an inlet section running in a first direction containing an inlet for letting a fluid into the flat tube;

an outlet section running in the first direction and containing an outlet for letting the fluid out from the flat tube, the outlet being spaced apart from the inlet in a second direction transverse to the first direction;

a heat exchange section arranged in the first direction between the inlet section and the outlet section; and a plurality of flow elements arranged in the heat exchange section;

wherein the fluid is flowable around at least a portion of the flow elements in such a manner that the fluid has a flow direction component perpendicular to the second direction;

wherein the outlet and the inlet are each delimited on a partial cross-sectional area of the flat tube and are arranged diagonally opposite one another, the outlet is at a first end of the flat tube and the inlet is at a second end of the flat tube that is opposite the first end; and wherein the flow elements are arranged in at least two lines spaced apart in the second direction, each line having at least two flow elements spaced apart in the first direction.

* * * * *